US005804543A

United States Patent [19]

Wertz et al.

[11] Patent Number: 5,804,543

[45] Date of Patent: Sep. 8, 1998

[54] DETERGENT COMPOSITIONS WITH OPTIMIZED SURFACTANT SYSTEMS TO PROVIDE DYE TRANSFER INHIBITION BENEFITS

[75] Inventors: William C. Wertz, Lawrenceburg, Ind.; Rajan K. Panandiker, West Chester, Ohio

[73] Assignee: The Procter & Gamble Company, Cincinnati, Ohio

[21] Appl. No.: 684,515

[22] Filed: Jul. 19, 1996

Related U.S. Application Data

[63] Continuation of Ser. No. 320,350, Oct. 11, 1994, abandoned.

[51] Int. Cl.[6] ..... C11D 1/29; C11D 1/83; C11D 3/30; C11D 3/395

[52] U.S. Cl. ..... 510/303; 510/302; 510/305; 510/307; 510/312; 510/318; 510/320; 510/321; 510/324; 510/325; 510/341; 510/349; 510/350; 510/351; 510/445; 510/500; 510/502; 510/503

[58] Field of Search ..... 510/302, 303, 510/305, 307, 312, 318, 320, 321, 324, 325, 341, 349, 350, 351, 445, 500, 502, 503

[56] References Cited

U.S. PATENT DOCUMENTS

| | | | |
|---|---|---|---|
| 3,714,050 | 1/1973 | Gray | 252/99 |
| 4,123,376 | 10/1978 | Gray | 252/99 |
| 4,146,496 | 3/1979 | Gray | 252/99 |
| 4,300,897 | 11/1981 | Gray | 8/111 |
| 4,545,919 | 10/1985 | Abel | 252/174.18 |
| 4,548,744 | 10/1985 | Connor | 252/545 |
| 4,675,124 | 6/1987 | Seiter et al. | 252/91 |
| 5,458,809 | 10/1995 | Fredj et al. | 252/542 |
| 5,466,802 | 11/1995 | Panandiker et al. | 544/193.2 |
| 5,633,225 | 5/1997 | Fredj et al. | 510/475 |

FOREIGN PATENT DOCUMENTS

| | | | |
|---|---|---|---|
| WO 94/02579 | 2/1994 | WIPO | C11D 3/00 |
| WO 94/02580 | 2/1994 | WIPO | C11D 3/00 |
| WO 94/11473 | 5/1994 | WIPO | C11D 1/04 |

OTHER PUBLICATIONS

U.S. application No. 08/150,644, Panandiker/Wertz/Hughes, filed Nov. 10, 1993.

*Primary Examiner*—Paul Lieberman
*Assistant Examiner*—Gregory R. Delcotto
*Attorney, Agent, or Firm*—Steven R. Chuey; Kim W. Zerby; Jacobus C. Rasser

[57] ABSTRACT

Disclosed are detergent compositions and methods which are suitable for washing colored fabrics in aqueous washing solution with little or no transfer of dye between fabrics. The compositions utilized comprise certain nil-LAS detersive surfactants, detergent builder and certain selected polymeric dye transfer inhibiting agents. The detersive surfactants used must comprise alkyl ether sulfates and certain types of nonionic surfactants (polyhydroxy fatty acid amides and/or alcohol ethoxylates). The polymeric dye transfer inhibiting agents are polyamine N-oxides such as poly(4-vinylpyridine-N-oxide), i.e., PVNO and/or copolymers of N-vinylpyrrolidone and N-vinylimidazole, i.e., PVPVI.

18 Claims, No Drawings

DETERGENT COMPOSITIONS WITH OPTIMIZED SURFACTANT SYSTEMS TO PROVIDE DYE TRANSFER INHIBITION BENEFITS

This is a continuation of application Ser. No. 08/320,350, filed on Oct. 11, 1994, abandoned.

FIELD OF THE INVENTION

This invention relates to laundry detergent compositions which can be used to wash dye-containing colored fabrics and which contain additives that inhibit dye transfer between fabrics during laundering operations.

BACKGROUND OF THE INVENTION

One of the most persistent and troublesome problem-causing events which arises during modern fabric laundering operations is the tendency of some colored fabrics to release dye into the laundering solutions. Such dye is then frequently transferred onto other fabrics being washed in the same aqueous washing solution.

One approach in attacking the dye transfer problem in laundering operations has been to complex or adsorb the fugitive dyes washed out of dyed fabrics before such dyes have the opportunity to become attached to other articles in the wash solution. Certain polymeric materials, for instance, have been suggested as being useful laundry detergent additives which can complex or adsorb fugitive dyes in aqueous washing solutions. For example Abel, U.S. Pat. No. 4,545,919; Issued Oct. 8, 1985 describes the use of carboxyl-containing polymers in fabric laundering operations. Waldhoffet al; DE-A-2 814 329, Published Oct. 11, 1979 discloses the use of N-vinyl-oxazolidone polymers and Cracco et al; GB 1,348,212; Published Mar. 13, 1974 discloses the use of 15–35% of a copolymer of polyvinylpyrrolidone and acrylic acid nitrile or maleic anhydride within a washing powder. Clements et al; EP-A-265 257; Published Apr. 27, 1988 describes detergent compositions comprising an alkali-metal carboxy-metal carboxymethylcellulose, a vinylpyrrolidone polymer and a polycarboxylate polymer.

Notwithstanding prior art attempts to solve the dye transfer problem during fabric laundering, there is a continuing need to identify detergent compositions, detergent composition additives and fabric laundering methods which are especially effective against dye transfer. Accordingly, it is an object of the present invention to provide detergent compositions which contain selected ingredients that eliminate or at least minimize dye transfer between fabrics when such compositions are used in fabric laundering operations.

It is a further object of the present invention to provide such especially effective dye transfer-inhibiting detergent compositions in either granular or liquid form.

It is a further object of the present invention to provide a method for laundering colored fabrics in aqueous washing solutions which are formed from the detergent compositions herein and which thereby contain materials that eliminate or at least minimize dye transfer between fabrics being washed therein.

SUMMARY OF THE INVENTION

The present invention is directed to laundry detergent compositions which provide especially effective inhibition of dye transfer between fabrics being laundered in aqueous washing solutions that are formed from these detergent compositions. Such detergent compositions comprise from about 5% to 60% by weight of a certain type of anionic surfactant component, from about 1% to 20% by weight of a certain type of nonionic surfactant component; from about 0.1% to 80% of a detergent builder component and from about 0.01% to 10% by weight of certain type of dye transfer inhibiting agent.

The anionic surfactant component is one which comprises alkylpolyethoxylate sulfates wherein the alkyl group contains from 10 to 22 carbon atoms, wherein the polyethoxylate chain contains from about 1 to 15 ethylene oxide moieties; and wherein unethoxylated alkyl sulfates comprise no more than about 50% by weight of this anionic surfactant component. The anionic surfactant component must also be substantially free of alkyl benzene sulfonate surfactant materials.

The nonionic surfactant component is one which essentially comprises a polyhydroxy fatty acid amide, an alcohol ethoxylate or, preferably, both of these types of nonionic surfactants. The polyhydroxy fatty acid amides are those of the formula:

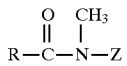

wherein R is a $C_{9-17}$ alkyl or alkenyl and Z is glycityl derived from a reduced sugar or alkoxylated derivatives thereof The alcohol ethoxylate nonionics are those of the formula:

$$R^1(OC_2H_4)_nOH$$

wherein $R^1$ is a $C_8$–$C_{16}$ alkyl group or a $C_6$–$C_{12}$ alkylphenol group and n is from about 3 to 80.

The detergent builder component can comprise any conventional organic or inorganic builder material. The polymeric dye transfer inhibiting agents can be polyamine N-oxide polymers, copolymers of N-vinylpyrrolidone and N-vinylimidazole or combinations of these polymers and copolymers.

DETAILED DESCRIPTION OF THE INVENTION

As noted, the laundry detergent compositions herein essentially contain an anionic surfactant component, a nonionic surfactant component, detergent builder, and certain polymeric dye transfer inhibiting agents. Each of these essential components as well as optional ingredients for such compositions and methods of using such compositions are described in detail as follows: All concentrations and ratios discussed hereinafter are on a weight basis unless otherwise specified.

A) Anionic Surfactant Component

The detergent compositions herein comprise from about 5% to 60% by weight of an anionic surfactant component. Preferably such compositions comprise from about 10% to 40% by weight of this anionic surfactant component.

A substantial portion, i.e., at least 50%, and more preferably at least 75%, of the anionic surfactant component will comprise ethoxylated alkyl sulfate surfactants. Such ethoxylated alkyl sulfates are those which correspond to the formula:

$$R^2\text{-O-}(C_2H_4O)_n\text{-}SO_3M$$

wherein $R^2$ is a $C_{10}$–$C_{22}$ alkyl group, n is from about 1 to 20, and M is a salt-forming cation. Preferably, $R^2$ is $C_{12}$–$C_{18}$ alkyl, n is from about 1 to 15, and M is sodium, potassium, ammonium, alkylammonium or alkanolammonium. Most preferably, $R^2$ is $C_{12}$–$C_{16}$ n is from about 1 to 6 and M is sodium. These materials, also known as alkyl ether sulfates, can provide especially desirable dye transfer inhibition benefits when used in combination with the specific polymeric dye transfer inhibiting agents hereinafter described.

The alkyl ether sulfates will generally be used in the form of mixtures comprising varying $R_2$ chain lengths and varying degrees of ethoxylation. Frequently such mixtures will inevitably also contain some unethoxylated alkyl sulfate materials, i.e. surfactants of the above ethoxylated alkyl sulfate formula wherein n=0. Such unethoxylated alkyl sulfate anionic surfactants tend to be less effective than are ethoxylated alkyl sulfates at inhibiting dye transfer in the context of the compositions of the present invention. Accordingly, it is important that anionic surfactant component herein contain no more than about 50% by weight of such component of unethoxylated alkyl sulfate materials. Preferably no more than about 25% by weight of the anionic surfactant component will comprise unethoxylated alkyl sulfates.

In addition to the essentially utilized ethoxylated alkyl sulfate surfactants, the anionic surfactant component of the compositions herein may also contain additional optional anionic surfactants so long as such additional optional materials are compatible with other composition components and do not substantially adversely effect composition performance, e.g., dye transfer inhibition or composition stability. Optional anionic surfactants which may be employed include in general the carboxylate-type anionics. Carboxylate-type anionics include fatty acid, e.g. $C_{10}$–$C_{18}$, soaps, the $C_{10}$–$C_{18}$ alkyl alkoxy carboxylates (especially the EO 1 to 5 ethoxycarboxylates) and the $C_{10}$–$C_{18}$ sarcosinates, especially oleoyl sarcosinate.

One common type of anionic surfactant which should not be utilized in the anionic surfactant component of the compositions herein comprises the sulfonated anionics which are alkyl benzene sulfonates. It has been found that non-bleach activating sulfonated anionic surfactants like linear alkyl benzene sulfonate (LAS) tend to interfere with the effectiveness of the polymeric dye transfer inhibiting agents used herein to reduce transfer of dyes between fabrics during fabric laundering operations. Accordingly, the anionic surfactant component of the detergent compositions herein should be substantially free of such alkyl benzene sulfonate anionic surfactant materials.

B) Nonionic Surfactant Component

The detergent compositions herein also essentially comprise from about 1% to 20% by weight of an nonionic surfactant component. Preferably such compositions will comprise from about 2% to 10% by weight of this nonionic surfactant component.

The nonionic surfactant component essentially comprises one, and preferably both, of two specific types of nonionic surfactant materials. These are polyhydroxy fatty acid amides and alcohol ethoxylates.

1) Polyhydroxy Fatty Acid Amides

One suitable component of the nonionic surfactant used in the detergent compositions herein comprises a polyhydroxy fatty acid amide surfactant. Materials of this type of nonionic surfactant are those which conform to the formula:

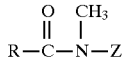

wherein R is a $C_{9-17}$ alkyl or alkenyl and Z is glycityl derived from a reduced sugar or alkoxylated derivative thereof. Such materials include the $C_{12}$–$C_{18}$ N-methyl glucamides. Examples are N-methyl N-1-deoxyglucityl cocoamide and N-methyl N-1-deoxyglucityl oleamide. Processes for making polyhydroxy fatty acid amides are known and can be found, for example, in Wilson, U.S. Pat. No. 2,965,576 and Schwartz, U.S. Pat. No. 2,703,798, the disclosures of which are incorporated herein by reference. The materials themselves and their preparation are also described in greater detail in Honsa, U.S. Pat. No. 5,174,937, Issued Dec. 26, 1992, which patent is also incorporated herein by reference.

When polyhydroxy fatty acid amide nonionic is used in the nonionic surfactant component of the detergent compositions herein, it will generally be present to the extent of from about 1% to 20% by weight of the composition. More preferably, polyhydroxy fatty acid amide nonionic can comprise from about 2% to 10% by weight of the compositions herein.

2) Alcohol Ethoxylates

Another suitable component of the nonionic surfactant used in the compositions herein comprises an ethoxylated fatty alcohol nonionic surfactant. Such materials are those which correspond to the general formula:

$R^1(C_2H_4O)_nOH$ wherein $R^1$ is a $C_8$–$C_{16}$ alkyl group or a $C_6$–$C_{12}$ alkylphenol group and n ranges from about 1 to 80. Preferably $R^1$ is an alkyl group, which may be primary or secondary, that contains from about 9 to 15 carbon atoms, more preferably from about 10 to 14 carbon atoms. Preferably the ethoxylated fatty alcohols will contain from about 2 to 12 ethylene oxide moieties per molecule, more preferably from about 3 to 10 ethylene oxide moieties per molecule.

The ethoxylated fatty alcohol nonionic surfactant will frequently have a hydrophilic-lipophilic balance (HLB) which ranges from about 3 to 17. More preferably, the HLB of this material will range from about 6 to 15, most preferably from about 10 to 15.

Examples of fatty alcohol ethoxylates useful as the essential liquid nonionic surfactant in the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylate nonionics useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

When alcohol ethoxylate nonionic is used in the nonionic surfactant component of the detergent compositions herein, it will generally be present to the extent of from about 0.5% to 10% by weight of the composition. More preferably, alcohol ethoxylate nonionic will comprise from about 1% to 5% by weight of the compositions herein.

3) Optional Nonionics

So long as the nonionic surfactant component of the compositions herein contains one or both of the foregoing types of nonionic surfactants, the nonionic surfactant component may also optionally contain additional compatible, non-interfering nonionics. These can include, for example, $C_{10}$–$C_{18}$ alkyl polyglucosides when high foaming compositions are desired, N-alkoxy polyhydroxy fatty acid amides, such as $C_{10}$–$C_{18}$ N-(3-methoxypropyl) glucamides (The N-propyl through N-hexyl $C_{12}$–$C_{16}$ glucamides can be used for low sudsing performance.), ethylene oxide-propylene oxide block polymers of the Pluronic type, and the like.

C) Detergent Builder

The detergent compositions herein also comprise from about 0.1% to 80% by weight of a detergent builder. Preferably such compositions in liquid form will comprise from about 1% to 10% by weight of the builder component. Preferably such compositions in granular form will comprise from about 1% to 50% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. Particularly preferred polycarboxylate builders are the oxydisuccinates and the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Examples of suitable nonphosphorus, inorganic builders include the silicates, aluminosilicates, borates and carbonates. Particularly preferred are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Also preferred are aluminosilicates including zeolites. Such materials and their use as detergent builders are more fully discussed in Corkill et al, U.S. Pat. No. 4,605,509, the disclosure of which is incorporated herein by reference. Also, crystalline layered silicates such as those discussed in Corkill et al, U. S. Pat. No. 4,605,509, incorporated herein by reference, are suitable for use in the detergent compositions of this invention.

D) Polymeric Dye Transfer Inhibiting Agents

The detergent compositions herein also comprise from about 0.01% to 10% by weight of certain types of polymeric dye transfer inhibiting agents. Preferably the detergent compositions herein comprise from about 0.05% to 0.5% by weight of these polymeric dye transfer inhibiting materials.

The selected dye transfer inhibiting polymeric materials can be certain polyamine N-oxide polymers, certain copolymers of N-vinylpyrrolidone and N-vinylimidazole or combinations of these types of materials. Each of these two polymer/copolymer types is described in greater detail as follows:

i) Polyamine N-oxide Polymers

The polyamine N-oxide polymers suitable for use herein contain units having the structural formula:

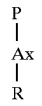

wherein P is a polymerizable unit to which a N—O group can be attached or the N—O group can form part of the polymerizable unit or the N—O group can be attached to both units; A is one of the following structures:

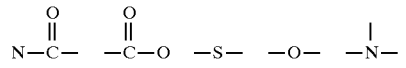

x is 0 or 1; and, R comprises aliphatic, ethoxylated aliphatic, aromatic, heterocyclic or alicyclic groups or any combination thereof to which the nitrogen of the N—O group can be attached or the N—O group is part of these groups.

The N—O group can be represented by the following general structures:

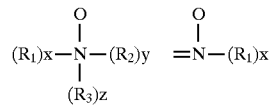

wherein $R_1$, $R_2$, $R_3$ are aliphatic, aromatic, heterocyclic or alicyclic groups or, combinations thereof; x, y and z are 0 or 1; and, the nitrogen of the N—O group can be attached or form part of any of the aforementioned groups. Further, the N—O group can be part of the polymerizable unit (P) or can be attached to the polymeric backbone or a combination of both.

Suitable polyamine N-oxides wherein the N—O group forms part of the polymerizable unit comprise polyamine N-oxides wherein R is selected from aliphatic, aromatic, alicyclic or heterocyclic groups. One class of such polyamine N-oxides comprises the group of polyamine N-oxides wherein the nitrogen of the N—O group forms part of the R group. Preferred polyamine N-oxides are those wherein R is a heterocyclic group such as pyrridine, pyrrole, imidazole, pyrrolidine, piperidine and derivatives thereof Another class of the polyamine N-oxides comprises the group of polyamine N-oxides wherein the nitrogen of the N—O group is attached to the R-group. Other suitable polyamine N-oxides are the polyamine oxides in which the N—O group is attached to the polymerizable unit. A preferred class of these polyamine N-oxides are the polyamine N-oxides having the general formula presented above wherein R is an aromatic, heterocyclic or an alicyclic group and the nitrogen of the N—O functional group is part of the R group. Examples of these classes are polyamine oxides wherein R is a heterocyclic compound such as pyrridine, pyrrole, imidazole and derivatives thereof.

Another preferred class of polyamine N-oxides are the polyamine oxides having the general formula presented above wherein R is an aromatic, heterocyclic or alicyclic group and the nitrogen of the N—O functional group is attached to the R group(s). Examples of these classes are polyamine oxides wherein R groups can be aromatic such as phenyl. Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof The amine N-oxide polymers useful in the detergent compositions of the present invention typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. Preferably, the ratio of amine to amine N-oxide is from 3:1 to 1:1000000. The polymers useful in the detergent compositions of the present invention actually encompass random or block copolymers where one monomer type is an amine N-oxide and the other monomer type is an N-oxide.

The amine oxide unit of the polyamine N-oxides has a pKa<10, preferably pKa<7, more preferred pKa<6. The polyamine oxides can be obtained in almost any degree of polymerization. The degree of polymerization is not critical provided the material has the desired water-solubility and dye-suspending power. Typically, the average molecular weight is within the range of 500 to 1,000,000; more preferred 1,000 to 500,000; most preferred 5,000 to 100,000.

The most preferred polyamine N-oxide useful in the detergent compositions herein is poly(4-vinylpyridine-N-oxide) which has an average molecular weight of about 50,000 and an amine to amine N-oxide ratio of about 1:4. This preferred material can be abbreviated as "PVNO".

The polyamine N-oxides useful in the present invention can be synthesized by polymerizing the amine monomer and oxidizing the resulting polymer with a suitable oxidizing agent or the amine oxide monomer may itself be polymerized to obtain the desired polyamine N-oxide. Such reaction schemes are well known and within the scope of those persons skilled in the art.

ii) Copolymers of N-vinylpyrrolidone and N-vinylimidazole

The detergent compositions of the present invention may also utilize a copolymer of N-vinylpyrrolidone and N-vinylimidazole (also abbreviated herein as "PVPVI"). It has been found that copolymers of N-vinylpyrrolidone and N-vinylimidazole can provide excellent dye transfer inhibiting performance when utilized in the compositions of this invention.

In a preferred embodiment, the copolymer of N-vinylpyrrolidone and N-vinylimidazole polymers has an average molecular weight range from 5,000 to 1,000,000, more preferably from 5,000 to 200,000. A highly preferred copolymer for use in detergent compositions according to the present invention has an average molecular weight range from 5,000 to 50,000, more preferably from 8,000 to 30,000 and, most preferably from 10,000 to 20,000. The average molecular weight range is determined by light scattering as described in Barth J. H. G. and Mays J. W. Chemical Analysis Vol 113. "Modern Methods of Polymer Characterization", the disclosure of which is incorporated herein by reference.

The copolymers of N-vinylpyrrolidone and N-vinylimidazole useful in the present invention can have a molar ratio of N-vinylimidazole to N-vinylpyrrolidone from 1:1 to 0.2:1, more preferably from 0.8:1 to 0.3:1, most preferably from 0.6:1 to 0.4:1. It should be understood that the copolymer of N-vinylpyrrolidone and N-vinylimidazole can be either linear or branched.

E) Optional Detergent Composition Ingredients

The detergent compositions of the present invention can also include any number of additional optional ingredients. These include conventional detergent composition components such as optional surfactants, bleaching agents and activators therefor, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents, optional brighteners and perfumes. A few of these optional ingredients are described in greater detail as follows:

1) Optional Surfactants

In addition to the optional anionic and nonionic surfactants hereinbefore described, the detergent compositions herein may contain other types of compatible surfactant materials. These include surfactants of the cationic and amphoteric types. Examples of such materials include $C_{10}$–$C_{18}$ amine oxides and the $C_{12}$–$C_{18}$ betaines and sulfobetaines.

2) Peroxygen Bleaching Agent, Preferably with Bleach Activator

Another common detergent composition component which can optionally be employed in the detergent compositions herein comprises a bleaching agent, e.g., a peroxygen bleach. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Bums et al.

Inorganic peroxygen bleaching agents may also be used, generally in particulate form, in the detergent compositions herein. Inorganic bleaching agents are in fact preferred. Such inorganic peroxygen compounds include alkali metal perborate and percarbonate materials. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical and preferred. Mixtures thereof can also be used. See also the hereinbefore referenced U.S. Pat. No. 4,634,551 for other typical bleaches and activators useful herein.

Other useful amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenol sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate and mixtures thereof as described in the hereinbefore referenced U.S. Pat. No. 4,634,551.

Another class of useful bleach activators comprises the benzoxazin-type activators disclosed by Hodge et al. in U.S. Pat. No. 4,966, 723, Issued Oct. 30, 1990, incorporated herein by reference. A highly preferred activator of the enzoxazin-type is:

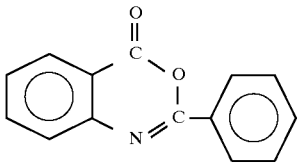

Still another class of useful bleach activators includes the acyl lactam activators, especially acyl caprolactams and acyl valerolactams of the formulae:

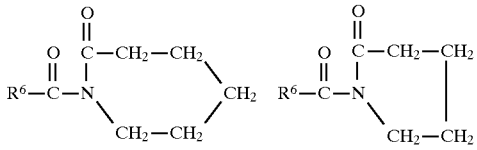

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, nonanoyl valerolactam, decanoyl valerolactam, undecenoyl valerolactam, 3,5,5-trimethylhexanoyl valerolactam and mixtures thereof See also U.S. Pat. No. 4,545,784, Issued to Sanderson, Oct. 8, 1985, incorporated herein by reference, which discloses acyl caprolactams, including benzoyl caprolactam, adsorbed into sodium perborate.

If utilized, peroxygen bleaching agent will generally comprise from about 2% to 30% by weight of the detergent compositions herein. More preferably, peroxygen bleaching agent will comprise from about 2% to 20% by weight of the compositions. Most preferably, peroxygen bleaching agent will be present to the extent of from about 3% to 15% by weight of the compositions herein. If utilized, bleach activators can comprise from about 2% to 10% by weight of the detergent compositions herein. Frequently, activators are employed such that the molar ratio of bleaching agent to activator ranges from about 1:1 to 10:1, more preferably from about 1.5:1 to 5:1.

3) Enzymes

While not essential to the detergent compositions of the present invention, it is preferable to include an enzyme component. Suitable enzyme components are available from a wide variety of commercial sources. For example, suitable enzymes are available from NOVO Industries under product names T-Granulate™ and Savinase™, and Gist-Brocades under product names Maxacal™ and Maxatase™. Included within the group of enzymes are proteases, amylases, lipases, cellulases and mixtures thereof The enzyme concentration preferably should be from about 0% to about 5%, more preferably from about 0.1% to about 2.5%, and most preferably from about 0.2% to about 1%. Typically, proteases are used at an Activity Unit (Anson Unit) level of from about 0.001 to about 0.05, most preferably from about 0.002 to about 0.02, while amylases are used at an amylase unit level of from about 5 to about 5000, most preferably from about 50 to about 500 per gram of detergent composition.

4) Optical Brighteners

A highly preferred optional component of the detergent compositions herein comprises an optical brightener. Certain types of hydrophilic optical brighteners can, in fact, enhance the dye transfer inhibition effects provided by the essential surfactant and polymeric dye transfer inhibiting agent components hereinbefore described.

Hydrophilic optical brighteners highly preferred for use in the detergent compositions of the present invention are those having the structural formula:

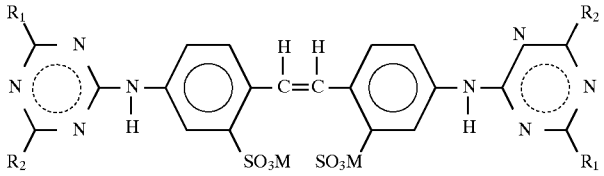

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula $R_1$ is anilino, $R_2$ is N-2-bis-hydroxyethyl and M is a cation such as sodium, the brightener is 4,4,'-bis[(4-anilino-6-(N-2-bis-hydroxyethyl)-s-triazine-2-yl)amino]-2,2'-stilbenedisulfonic acid disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4,'-bis[(4-anilino-6-(N-2-hydroxyethyl-N-methylamino)-s-triazine-2-yl)amino]-2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4,'-bis[(4-anilino-6-morphilino-s-triazine-2-yl)amino]-2,2'-stilbenedisulfonic acid, sodium salt. This particular brightener species is commercially marketed under the tradename Tinopal AMS-GX by Ciga-Geigy Corporation.

The specific optical brightener species preferred for optional use in the compositions of the present invention provide especially effective dye transfer inhibition performance benefits when used in combination with the essential selected polymeric dye transfer inhibiting agents hereinbefore described. Without being bound by theory, it is believed that such brighteners work this way because they have high affinity for fabrics in the wash solution and therefore deposit relatively quickly on these fabrics. The extent to which brighteners deposit on fabrics in the wash solution can be defined by a parameter called the "exhaustion coefficient." The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention. The detergent compositions herein will preferably contain from about 0.005% to 5% by weight of this hydrophilic optical brightener as hereinbefore. Most preferably, the compositions herein will comprise from about 0.01% to 1% by weight of such optical brighteners.

F) Detergent Composition Formulation

The detergent compositions according to the present invention can be in liquid, paste or granular forms. Such compositions can be prepared by combining the essential and optional components in the requisite concentrations in any suitable order and by an conventional means.

Granular compositions, for example, are generally made by combining base granule ingredients (e.g. surfactants, builders, water, etc.) as a slurry, and spray drying the resulting slurry to a low level of residual moisture (5–12%). The remaining dry ingredients can be admixed in granular powder form with the spray dried granules in a rotary mixing drum and the liquid ingredients (e.g. enzymes, binders and perfumes) can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulfates and chlorides, typically sodium sulfate; "compact" detergents typically comprise not more than 10% filler salt.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents.

G. Fabric Laundering Method

The present invention also provides a method for laundering colored fabrics with little or no dye transfer taking place. Such a method employs contacting these fabrics with an aqueous washing solution formed from an effective amount of the detergent compositions hereinbefore described. Contacting of fabrics with washing solution will generally occur under conditions of agitation.

Agitation is preferably provided in a washing machine for good cleaning. Washing is preferably followed by drying the wet fabric in a conventional clothes dryer. An effective amount of the liquid or granular detergent composition in the aqueous wash solution in the washing machine is preferably from about 500 to about 7000 ppm, more preferably from about 1000 to about 3000 ppm.

EXAMPLES

The following examples illustrate the compositions of the present invention, but are not necessarily meant to limit or otherwise define the scope of the invention.

Example I

Several liquid detergent compositions are prepared. The formulation for these compositions are set forth in Table I.

TABLE I

Liquid Detergent Compositions

| Component | Wt. % A | B | C | D |
|---|---|---|---|---|
| $C_{12}$–$C_{15}$ Alkyl sulfate | — | 9.35 | 9.35 | — |
| $C_{12}$–$C_{15}$ Alkyl ethoxylated (EO-2.25)sulfate | 15.81 | 15.15 | 15.15 | 18.00 |
| $C_{12}$–$C_{14}$ N-methyl glucamide | — | 6.00 | 6.00 | 5.00 |
| $C_{12}$–$C_{14}$ Fatty alcohol ethoxylate | 2.5 | 6.00 | 6.00 | 2.00 |
| $C_{12}$–$C_{16}$ Fatty acid | 2.7 | 7.00 | 7.00 | 2.5 |
| Citric acid anhydrous | 4.13 | 4.00 | 4.00 | 3.00 |
| Diethylene triamine penta ethylene phosphonic acid (DTPA) | 0.65 | 0.5 | 0.5 | — |
| Monoethanolamine | — | 5.5 | 5.5 | 1.09 |
| Propanediol | 7.82 | 10.5 | 10.5 | 8.00 |
| Ethanol | — | 4.00 | 4.00 | 3.56 |
| Enzymes (protease, lipase, cellulase) | 0.02 | 5.31 | 5.31 | 1.69 |
| Terephthalate-based polymer | 0.32 | 0.17 | 0.17 | — |
| Boric acid | 1.72 | 4.50 | 4.50 | 3.50 |
| Tetraethylene pentaamine ethoxylate (16) | 0.69 | 0.70 | 0.70 | 1.18 |
| Suds Suppressor | — | 0.20 | 0.20 | 0.085 |
| Na Formate | 0.11 | 0.40 | 0.40 | 0.11 |
| Poly(4-vinylpyridine)-N-oxide (PVNO) | 0.1 | 0.1 | — | 0.1 |
| N-vinylpyrrolidone/N-vinylimidazole copolymer - MW 10,000 (PVPVI) | — | — | 0.1 | — |
| Tinopal UNPA-GX Brightener | — | 0.15 | 0.15 | 0.05 |
| Na Cumene Sulfonate | — | — | — | 3.00 |
| Water & minors | up to 100% | | | |

The compositions described in Table I are suitable for laundering colored fabrics in aqueous washing solution while providing excellent dye transfer inhibition benefits.

Example II

Concentrated built heavy duty liquid detergent compositions are prepared having the formulations set forth in Table II.

TABLE II

Liquid Detergent Compositions

| Component | Wt. % A | B |
|---|---|---|
| $C_{14-15}$ Alkyl polyethoxylate (2.25) sulfonic acid | 23.00 | — |
| $C_{12}$–13 Linear alkyl benzene sulfonic acid | — | 23.00 |
| 1,2 Propanediol | 10.50 | 3.97 |
| Monoethanolamine | 12.50 | 3.65 |
| $C_{12-13}$ Alkyl polyethoxylate (6.5) | 6.00 | 1.78 |
| Ethanol | 3.80 | 1.75 |
| Polyhydroxy $C_{12-14}$ fatty acid amide | 9.00 | — |
| $C_{12-14}$ Coconut fatty acid | 9.00 | 2.60 |
| Citric acid | 6.00 | 6.04 |
| DTPA | 0.95 | — |
| Sodium formate | 0.14 | — |
| Boric acid | 2.4 | 1.0 |
| Tetraethylenepentaamine ethoxylate (15–18) | 1.00 | 1.44 |
| Soil release polymer | 0.46 | — |
| Enzymes (protease, lipase, cellulase) | 2.55 | 2.27 |
| Silicone antifoam composition | 0.04 | 0.02 |
| Poly(4-vinylpyridine)-N-oxide (PVNO) | 0.10 | 0.10 |
| Water and miscellaneous minors | Balance to 100% | |

The liquid detergent Composition A of Table II has dye transfer inhibition performance characteristics which are superior to those of the Table II, Composition B which uses the conventional anionic surfactant LAS.

Example III

Several compact granular detergent compositions are prepared. The formulations for these compositions are set forth in Table III.

TABLE III

Granular Detergent Compositions

| Component | Wt. % A | B | C |
|---|---|---|---|
| $C_{11}$–$C_{14}$ Linear alkyl benzene sulfonate | — | — | 11.40 |
| $C_{12}$–$C_{15}$ Alkyl alkoxylated (EO-2.25) sulfate | 5.00 | 10.00 | — |
| $C_{12}$–$C_{14}$ N-methyl glucamide | 8.00 | — | — |
| Tallow alkyl sulfate | 1.80 | 1.80 | 1.80 |
| $C_{45}$ alkyl sulfate | 3.00 | 3.00 | 3.00 |
| $C_{45}$ alcohol 7 times ethoxylated | 4.00 | 4.00 | 4.00 |
| Tallow alcohol 11 times ethoxylated | 1.80 | 1.80 | 1.80 |
| Dispersant | 0.07 | 0.07 | 0.07 |
| Silicone fluid | 0.80 | 0.80 | 0.80 |
| Trisodium citrate | 14.00 | 14.00 | 14.00 |
| Citric acid | 3.00 | 3.00 | 3.00 |
| Zeolite | 32.50 | 32.50 | 32.50 |
| Maleic acid acrylic acid copolymer | 5.00 | 5.00 | 5.00 |
| Celiulase (actve protein) | 0.03 | 0.03 | 0.03 |
| Alkalase/BAN | 0.60 | 0.60 | 0.60 |
| Lipase | 0.36 | 0.36 | 0.36 |
| Sodium silicate | 2.00 | 2.00 | 2.00 |
| Sodium sulfate | 3.50 | 3.50 | 3.50 |
| Poly(4-vinylpyridine)-N-oxide (PVNO) | 0.10 | 0.10 | — |
| N-vinylpyrrolidone/N-vinylimidazole copolymer - MW 10,000 (PVPVI) | — | — | 0.20 |
| Brightener - Tinopal UNPA-GX | 0.20 | — | 0.20 |
| Brightener - Tinopal 5BM-GX | — | 0.20 | — |
| Misc.(water, minors, etc) | Balance to 100% | | |

The Compositions A and B described in Table III are suitable for laundering colored fabrics in aqueous solutions while providing excellent dye transfer inhibition benefits. Dye transfer inhibition performance provided by these compositions is superior to that provided by Composition C which utilizes LAS as the anionic surfactant.

Example IV

A concentrated heavy duty granular detergent product is prepared having the composition set forth in Table IV.

TABLE IV

Compact Granular Detergent

| Component | Wt. % |
|---|---|
| $C_{14-15}$ Alkyl ethoxy (EO-2.25) sulfonic acid | 5.44 |
| $C_{12-14}$ N-methyl glucosides | 12.70 |
| $C_{12-14}$ Alkyl ethoxylate | 0.50 |
| Alumino silicate (76%) | 25.40 |
| Polyacrylate | 3.12 |
| PEG-8000 (50%) | 1.53 |
| Silicone suds suppressor | 0.02 |
| Enzymes | 1.29 |
| Citric acid | 3.50 |
| Perborate | 2.00 |
| PVNO | 0.10 |
| Moisture/sodium sulfate/aesthetics/$NaCO_3$/minors, unreacted material | Balance to 100% |

The granular detergent composition of Table IV has dye transfer inhibition performance chacteristics which are substantially similar to those of the Table III, Compositions A and B.

What is claimed is:

1. A laundry detergent composition that provides both especially effective soil and stain removal from, and especially effective inhibition of dye transfer between, fabrics being laundered in aqueous washing solutions formed from such a composition, which composition comprises:

A) from about 5% to 60% by weight of an anionic surfactant component i) which comprises alkylpolyethoxylate sulfates wherein the alkyl group contains from about 10 to 22 carbon atoms, wherein the polyethoxylate chain contains from about 1 to 15 ethylene oxide moieties and wherein unethoxylated alkyl sulfates comprise no more than about 25% by weight of said anionic surfactant component; and (ii) which is substantially free of non-bleach activating sulfonated anionic surfactants;

B) from about 1% to 20% by weight of a nonionic surfactant component which comprises nonionic materials selected from i) polyhydroxy fatty acid amides of the formula

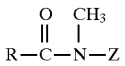

wherein R is a $C_{9-17}$ alkyl or alkenyl and Z is glycityl derived from a reduced sugar or alkoxylated derivatives thereof;

ii) alcohol ethoxylates of the formula $R^1(OC_2H_4)_nOH$ wherein $R^1$ is a $C_8$–$C_{16}$ alkyl group or a $C_8$–$C_{12}$ alkylphenol group and n is from about 3 to 80; and iii) combinations of said fatty acid amides and alcohol ethoxylates;

C) from about 0.1% to about 80% of detergent builder component; and

D) from about 0.01% to 10% by weight of a polymeric dye transfer inhibiting agent selected from polyamine N-oxide polymer.

2. A composition according to claim 1 wherein a) the anionic surfactant component comprises alkyl ether sulfates containing from about 12 to 18 carbons in the alkyl chain and from about 1 to 15 moles of ethylene oxide and further comprises no more than about 25% by weight of unethoxylated alkyl sulfates; and b) the nonionic surfactant component comprises both i) $C_{10}$–$C_{18}$ alkyl N-methyl glucamides; and ii) $C_{10}$ to $C_{14}$ alcohol ethoxylates containing from about 3 to 10 moles of ethylene oxide.

3. A composition according to claim 2 wherein the polyamine N-oxide polymer is polyvinylpyridine N-oxide having an amine to amine N-oxide molar ratio of from about 3:1 to 1:1,000,000 and an average molecular weight of from about 1,000 to 500,000.

4. A composition according to claim 1 which additionally contains from about 0.005% to 5% by weight of a hydrophilic optical brightener having the formula:

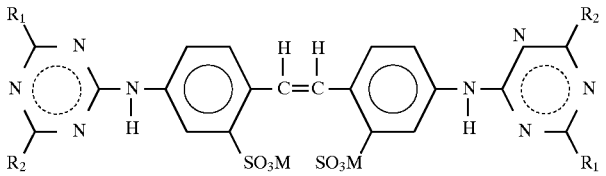

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation.

5. A liquid laundry detergent composition that provides especially effective inhibition of dye transfer between fabrics being laundered in aqueous washing solutions formed from such a composition, which composition comprises:

a) from about 10% to 40% by weight of an anionic surfactant component i) which comprises alkylpolyethoxylate sulfates wherein the alkyl group contains from about 12 to 16 carbon atoms, wherein the polyethoxylate chain contains from about 1 to 6 ethylene oxide moieties and wherein unethoxylated alkyl sulfates comprise no more than about 25% by weight of said anionic surfactant component; and ii) which is substantially free of non-bleach activating sulfonates anionic surfactants;

b) from about 2% to 10% by weight of a nonionic surfactant component which comprises both i) polyhydroxy fatty acid amides which are $C_{12}$–$C_{18}$ N-methyl glucamides; and ii) alcohol ethoxylates of the formula $R^1(OC_2H_4)_nOH$ wherein $R^1$ is a $C_{10}$–$C_{14}$ alkyl group and n is from about 3 to 10;

c) from about 1% to 10% by weight of a detergent builder component selected from carboxylate and polycarboxyate builders; and d) from about 0.05% to 0.5% by weight of a polymeric dye transfer inhibiting agent selected from polyamine N-oxides having an anionic to amine N-oxide molar ratio of from about 10:1 to 1:1,000,000 and having an average molecular weight of from about 500 to 1,000,000.

6. A liquid detergent composition according to claim 5 wherein the detergent builder component is selected from alkali metal citrates.

7. A liquid detergent composition according to claim 5 which additionally contains from about 0.01% to 1% of a hydrophilic optical brightener selected from a) 4,4,'-bis[(4-anilino-6-(N-2-bis-hydroxyethyl)-s-triazine-2-yl)amino]-2,2'-stilbenedisulfonic acid disodium salt;

b) 4,4,'-bis[(4-anilino-6-(N-2-hydroxyethyl-N-methylamino)-s-triazine-2-yl)amino]-2,2'-stilbenedisulfonic acid disodium salt; and c) 4,4,'-bis[(4-anilino-6-morphilino-s-triazine-2-yl) amino]-2,2'-stilbenedisulfonic acid, sodium salt.

8. A liquid detergent composition according to claim 7 which also comprises from about 0.1% to 2.5% by weight of an enzyme component selected from proteases, lipases, amylases, cellulases and combinations of said enzymes.

9. A liquid detergent composition according to claim 8 wherein a) the dye transfer inhibiting agent is poly(4-vinylpyridine-N-oxide) having an amine to amine N-oxide ratio of about 1:10 and an average molecular weight of from about 10,000; and b) the optical brightener is 4,4'-bis[(4-anilino-6-(N-2-bis hydroxyethyl)-s-triazine-2-yl) amino]-2,2'-stilbenedisulfonic acid disodium salt.

10. A granular laundry detergent composition that provides especially effective inhibition of dye transfer between fabrics being laundered in aqueous washing solutions formed from such a composition, which composition comprises:

a) from about 10% to 40% by weight of an anionic surfactant component i) which comprises alkylpolyethoxylate sulfates wherein the alkyl group contains from about 12 to 16 carbon atoms, wherein the polyethoxylate chain contains from about 1 to 6 ethylene oxide moieties and wherein unethoxylated alkyl sulfates comprise no more than about 25% by weight of said anionic surfactant component; and ii) which is substantially free of non-bleach activating sulfonated anionic surfactants;

b) from about 2% to 10% by weight of a nonionic surfactant component which comprises both i) polyhydroxy fatty acid amides which are $C_{12}$–$C_{18}$ N-methyl glucamides; and ii) alcohol ethoxylates of the formula $R^1(OC_2H_4)_nOH$ wherein $R^1$ is a $C_{10}$–$C_{14}$ alkyl group and n is from about 3 to 10;

c) from about 1% to 50% by weight of a detergent builder component selected from sodium carbonate, sodium silicate, crystalline layered silicates, aluminosilicates, oxydisuccinates and citrates; and d) from about 0.05% to 0.5% by weight of a polymeric dye transfer inhibiting agent selected from polyamine N-oxides having an anionic to amine N-oxide molar ratio of from about 10:1 to 1;1,000,000 and having an average molecular weight of from about 500 to 1,000,000.

11. A granular detergent composition according to claim 10 which additionally contains from about 0.01% to 1% of a hydrophilic optical brightener selected from a) 4,4,'-bis[(4-anilino-6-(N-2-bis-hydroxyethyl)-s-triazine-2-yl)amino]-2,2'-stilbenedisulfonic acid disodium salt;

b) 4,4,'-bis[(4-anilino-6-(N-2-hydroxyethyl-N-methylamino)-s-triazine-2-yl)amino]-2,2'-stilbenedisulfonic acid disodium salt; and c) 4,4,'-bis[(4-anilino-6-morphilino-s-triazine-2-yl) amino]-2,2'-stilbenedisulfonic acid, sodium salt.

12. A granular detergent composition according to claim 10 which additionally contains from about 0.1% to 2.5% by weight of an enzyme component selected from proteases, lipases, amylases, cellulases and combinations of said enzymes.

13. A granular detergent composition according to claim 10 which additionally contains from about 2% to 30% by weight of a peroxygen bleaching agent selected from percarboxylic acids and salts thereof and alkali metal perborates and percarbonates.

14. A granular detergent composition according to claim 13 wherein a) said peroxygen bleaching agent is selected from alkali metal perborates and percarbonates; and b) said composition further comprises from about 2% to 10% by weight of the composition of a bleach activator which can react with said peroxygen bleaching agent to form a peroxy acid.

15. A granular detergent composition according to claim 14 wherein said bleach activator is selected from nonanoyloxybenzene sulfonate and tetraacetyl ethylene diamine.

16. A granular detergent composition according to claim 14 wherein a) the dye transfer inhibiting agent is poly(4-vinylpyridine-N-oxide) having an amine to amine N-oxide ratio of about 1:10 and an average molecular weight of about 10,000; and b) the optical brightener is 4,4'-bis[(4-anilino-6-(N-2-bis hydroxyethyl)-s-triazine-2-yl) amino]-2,2'-stilbenedisulfonic acid disodium salt.

17. A method for cleaning colored fabrics in the wash with little or no dye transfer between fabrics, said method comprising contacting said fabrics with a wash solution formed from an effective amount of a detergent composition according to claim 1.

18. A method according to claim 17 wherein the polymeric dye transfer inhibiting agent in said detergent composition comprises poly(4-vinylpyridine-N-oxide).

* * * * *